US006677916B2

(12) United States Patent
Skalina et al.

(10) Patent No.: US 6,677,916 B2
(45) Date of Patent: Jan. 13, 2004

(54) COMMON APERTURE UHF/VHF ANTENNA

(75) Inventors: Andre Skalina, Portland, ME (US); John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 09/875,131

(22) Filed: Jun. 7, 2001

(65) Prior Publication Data

US 2002/0084949 A1 Jul. 4, 2002

Related U.S. Application Data

(60) Provisional application No. 60/258,548, filed on Dec. 29, 2000.

(51) Int. Cl.[7] ..... H01Q 1/12; H01Q 21/00

(52) U.S. Cl. ..... 343/890; 343/792; 343/810

(58) Field of Search ..... 343/767, 770, 343/890, 872, 790, 791, 792, 810

(56) References Cited

U.S. PATENT DOCUMENTS

| | | | | | |
|---|---|---|---|---|---|
| 3,886,559 | A | * | 5/1975 | Lanson et al. | 343/726 |
| 4,087,823 | A | * | 5/1978 | Faigen et al. | 343/791 |
| 4,609,866 | A | * | 9/1986 | Loftness | 324/551 |
| 4,899,165 | A | * | 2/1990 | Schadler | 343/727 |
| 4,907,008 | A | * | 3/1990 | Diennes | 343/727 |
| 5,021,797 | A | * | 6/1991 | Dienes | 343/727 |
| 5,506,591 | A | * | 4/1996 | Dienes | 343/792 |

* cited by examiner

*Primary Examiner*—Tan Ho
(74) *Attorney, Agent, or Firm*—Baker & Hostetler, LLP

(57) ABSTRACT

A slotted coaxial antenna design that accomplishes simultaneous UHF and either VHF broadcast, is disclosed. This design combines a DTV channel broadcast system, where the radio frequency signals are in the UHF band (i.e. slotted coaxial UHF antenna), with an NTSC broadcast system where the radio frequency is in the low and mid VHF band (i.e. circularly polarized VHF antenna), using a common antenna aperture.

19 Claims, 3 Drawing Sheets

COMMON APERTURE UHF/VHF ANTENNA

PRIORITY

This application claims priority to the provisional U.S. patent application entitled, A Common Aperture UHF/Circularly Polarized Low and Mid Band VHF Antenna, filed Dec. 29, 2000, having a Ser. No. 60/258,548, the disclosure of which is hereby incorporated by reference.

FIELD OF THE INVENTION

The present invention generally relates to the field of broadcast antenna designs. More particularly, the present invention relates to the design of a television broadcast antenna that would allow for simultaneous UHF and either low- or mid-band VHF broadcast with equal or less wind load than existing VHF only antennas.

BACKGROUND OF THE INVENTION

The majority of Ultra High Frequency (UHF) antennas used in National Television System Committee (NTSC) antenna systems are slotted coaxial designs. UHF slotted coaxial antennas gained widespread use in NTSC broadcasting because of their above-average performance characteristics; namely, excellent omni-directional azimuth patterns, low wind loads, and smooth null fill.

While the foregoing performance characteristics are also desirable for digital television (DTV) transmission, the more stringent antenna output performance standards of DTV transmission cannot be met with current slotted coaxial antenna designs. At the present stage of antenna development, the antenna output response performance across multiple channels, which was given little consideration in NTSC systems, is now an important parameter for DTV transmission.

For example, when used as television broadcasting antennas, slotted coaxial antennas are generally optimized to transmit signals for a specified television channel having a six MHz band width. For NTSC transmission, the power distribution across this six MHz band width is concentrated at three basic carrier frequencies; namely, picture, color and aural. Therefore, the performance of the antenna is critical only at these three carrier frequencies.

However, for DTV transmission, the power is equally distributed across a 5.4 MHz frequency span within the six MHz band width. Therefore, the antenna's performance is critical across substantially the entire operating band. This means that the antenna's elevation pattern must remain stable (i.e. unchanged) at all frequencies within the band width, and not just at isolated frequencies.

Use of coaxial antennas for DTV transmission is therefore hindered by the fact that slotted coaxial antennas are not suitable for multi-channel applications, such as simultaneous UHF and VHF signaling. This is due in part to the fact that the slots are not broadband radiators.

However, there are over 400 Very High Frequency (VHF) television stations that have already been assigned UHF DTV channels. As a practical matter then, the onset of DTV has thus complicated the antenna selection decision for broadcasters who must now operate VHF/DTV antenna systems simultaneously with their existing UHF/NTSC antenna systems. It would be desirable therefore to provide a replacement antenna that would allow for simultaneous UHF and either low- or mid-band VHF broadcast with equal or less wind load than existing VHF only antennas.

SUMMARY OF THE INVENTION

The antenna of the present invention satisfies to a great extent the foregoing need for an improved slotted coaxial antenna design. It combines a DTV channel broadcast system, where the radio frequency signals is in the UHF band, with a NTSC broadcast system, where the radio frequency is in the low and mid VHF band, using a common antenna aperture.

In one aspect of the invention a slotted coaxial antenna constituting a replacement antenna useful for simultaneous UHF and either low- or mid-band VHF broadcast, is provided. The basic design of the replacement antenna involves a marriage between two different types of television broadcast antennas: a slotted coaxial UHF antenna and a circularly polarized VHF antenna.

This slotted coaxial antenna comprises an elongated cylindrical, hollow mast. The mast acts as an outer conductor and support for one or more VHF dipole arms.

On the outside of the mast is arranged a plurality of substantially equidistant, longitudinally extending spaced slots. Each slot is formed in the mast for the purpose of radiating electromagnetic energy. Slots cut in the outer conductor are used for UHF broadcast.

In a preferred embodiment, the VHF antenna of the present invention uses five (5) layers of radiators (i.e. VHF dipole arms) with three radiators mounted symmetrically around the antenna per layer. In other words VHF broadcast, in this instance, is accomplished by employing fifteen substantially equidistantly spaced dipole arms. Alternatively and optionally, seven layers of radiators (i.e. 21 dipole arms) can be used. Each radiator is fed by a single feedline.

On the inside, the mast coaxially surrounds a longitudinally extending UHF inner conductor, which consists of a UHF slotted coaxial antenna. In one embodiment, the UHF inner conductor is surrounded substantially equidistantly by six UHF couplers. Each coupler is located on the inside of the mast between the ends of each longitudinal slot. Four centering pins are used to hold the UHF inner conductor centered within the outer conductor.

A significant result of this slotted coaxial antenna design is an antenna output response performance that is suitable for both low- or mid-band VHF as well as UHF DTV broadcasts.

Another significant result is the achievement of DTV and NTSC signal coverage with equal or less tower wind loading that current VHF only antennas.

As a practical matter, the common aperture UHF/circularly polarized low-and mid-band VHF antenna of the present invention also results in substantial economic savings, since the broadcast of UHF and low/mid-band VHF signals can be transmitted from one common aperture.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
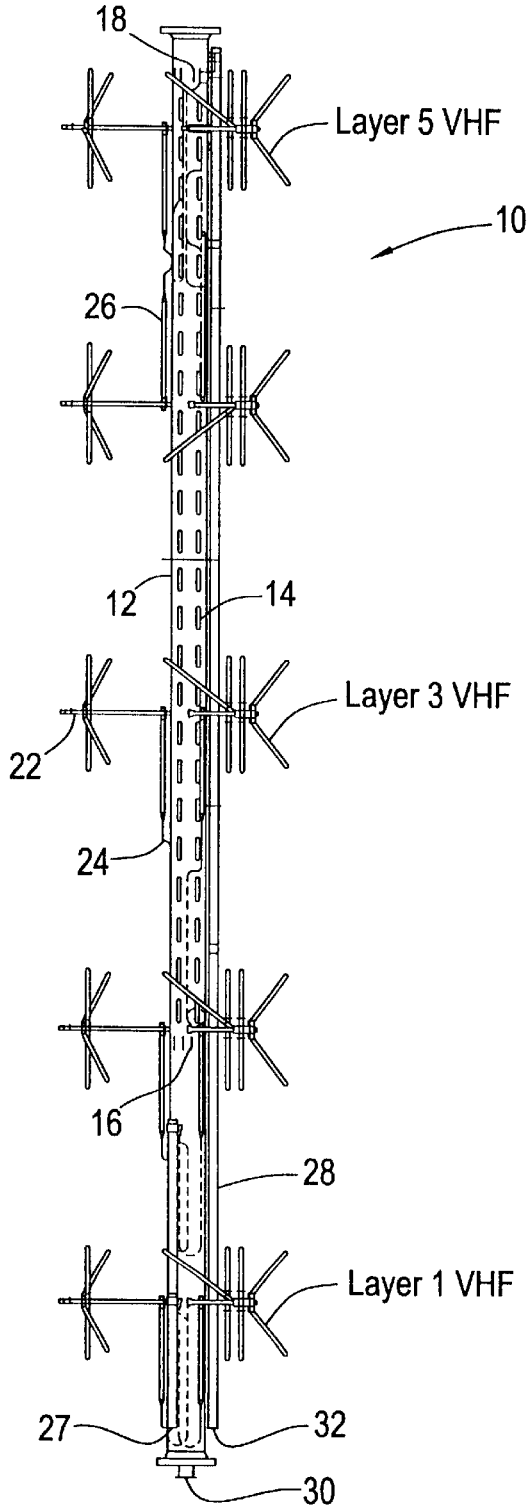
FIG. 1 is a side perspective view of a common aperture UHF/circularly polarized low- and mid-band VHF slotted coaxial antenna in accordance with a preferred embodiment of the present invention.

Referring now to the figures wherein like reference numerals indicate like elements, in FIG. 1, there is shown an embodiment of a circularly polarized low and mid-band VHF/UHF common aperture slotted coaxial antenna 10. The common aperture slotted coaxial antenna 10 includes an elongated, cylindrical hollow mast 12, which surrounds an inner conductor. The mast 12 acts as a UHF coaxial antenna outer conductor and is preferably constructed of a suitable material, such as steel or aluminum.

A plurality of longitudinally spaced slots 14 are formed on the outside of the mast 12. The slots of the UHF antenna are located in such a way as to minimize the effect of the VHF dipoles on the radiation patterns. The group of slots 14 located at the bottom-most and top-most ends of the antenna represent the bottom short and top short locations 16, 18, respectively for the UHF slotted coaxial antenna 20 (shown in FIG. 2).

Also located on the outside of the mast 12 are a plurality of dipole arms 22 for VHF broadcast. Three dipole arms 22, which are equally spaced concentrically around the antenna, form one layer. In a preferred embodiment, the present invention employs five layers (i.e. fifteen VHF dipoles). Each dipole is fed via a feedline 24 that is connected to a corresponding radiator transform section 26. Preferably, each dipole 22 is fed from a three-way power divider at each VHF layer. A coaxial feedline 28 feeds the top three layers of the VHF dipoles 22.

A branch type feed system is preferably used to achieve excellent vertical pattern stability. One junction box may be used to feed the upper three layers while another box feeds the lower two layers.

The common aperture antenna of the present invention comprises an input 30 to the UHF slotted coaxial antenna. It also comprises an input 32 (to feedline 28) to the top three layers of the VHF dipoles 22, and an input 27 to the bottom two VHF dipole layers.

It must be noted that the common aperture antenna concept is not limited to the number of slots or dipoles shown in FIG. 1. Various antenna gains can be achieved for both the VHF and UHF channels by changing the number of layers as desired. The primary restriction to the number of possible VHF and/or UHF layers, which can be an odd or even number, is the mechanical constraints of the mast.

Figure 2:
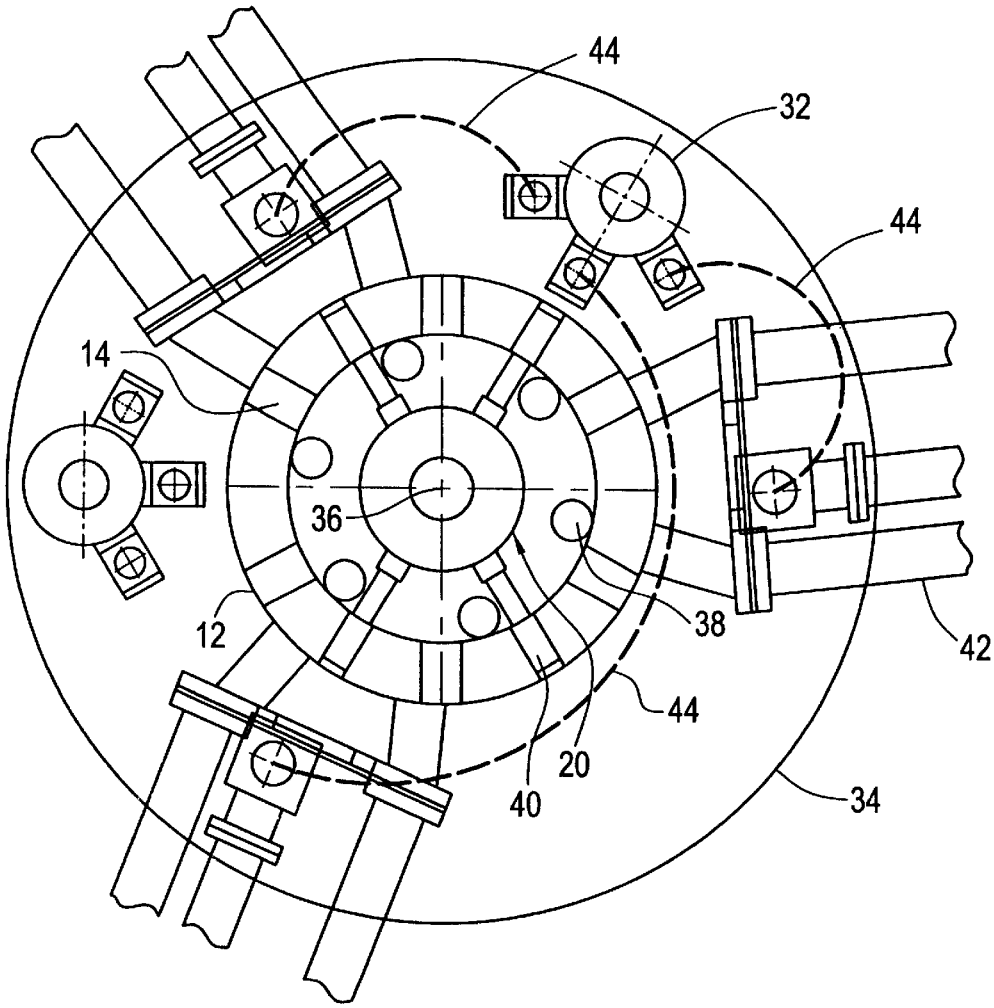
FIG. 2 is a bottom cut away view of the slotted coaxial antenna of FIG. 1.

Referring now to FIG. 2, there is shown a botom cut away view of the common aperture antenna of FIG. 1. A radome 34, which is a non-conductive shell, is used to protect the mast 12. The mast coaxially surrounds a longitudinally extending UHF inner conductor. The UHF inner conductor 20 also acts as the UHF outer feedline, and surrounds a UHF inner feedline 32.

In one embodiment, the UHF inner conductor 20 is surrounded substantially equidistantly by six UHF couplers 38. Each coupler 38 is generally constructed in a similar fashion, and is secured to the inside of the mast 12 by conventional mechanisms. The couplers 38 are arranged to extend immediately adjacent a slot 14. Each coupler 38 is located on the inside of the mast between the ends of each longitudinal slot 14.

Four centering pins 40 are used to hold the UHF inner conductor 20 centered within the mast 12. Centering pins 40 are non-conductive, movable/adjustable supports that hold the inner conductor 20 centered within the outer conductor (i.e. the mast) without making an electrical connection between the inner and outer.

One example of the support 42 for the VHF dipole arm is shown in FIG. 2. The three supports 42 are substantially equidistantly arranged around the mast 12. In addition, each support 42 is provided with a flexible feed line 44 to feed each dipole arm 22 at each VHF layer. Each feed line 44 derives its power from transmission line feed 32 carrying the VHF signal to each half of the antenna. It should be understood that the VHF dipole antenna supports 42 separate, electrically, the UHF coaxial antenna from the VHF dipole antennas.

Figure 3:
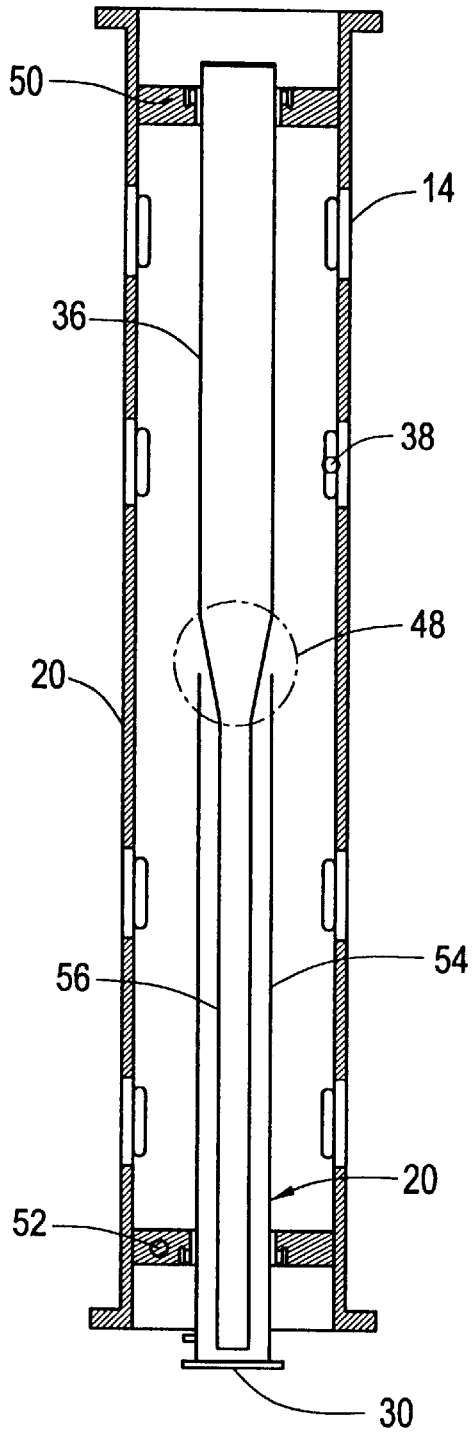
FIG. 3 is a side cut away view of the slotted coaxial antenna of FIG. 1.

FIG. 3 provides a more detailed drawing of the UHF feed (i.e. center feed) for the common aperture antenna of the present invention. Each slot 14 is configured with a UHF coupler 38, which is located on the inside of the mast 12 between the ends of each longitudinal slot 14.

There is a feed point 48 substantially intermediate of the top short 50 and the bottom short 52 locations. The feed point 48 provides power to the upper and lower halves of the antenna.

The antenna further comprises a UHF antenna input 30, which consists of the transmission line outer 54 and a transmission line inner 56. The signal feed going into the antenna input 30 is the physical input connection. The signal coming in from antenna input 30 travels up to the feed point 48 and splits in half, with a portion of the signal traveling above and below the feed point 48.

The advantage of center feeding here is that the signal travels outward from the center in both directions. The resultant phase taper across the entire aperture of the antenna is therefore zero. In addition, the beam sway associated with frequency change is thus eliminated.

Moreover, the above slotted coaxial antenna design is not limited to an internally center fed harness design. However, the center fed design allows for illuminations (i.e., the relative radiated amplitude and phase from layer to layer in the elevation plane) to be chosen, such that the majority of energy is emanated from the center portion of the slots in the antenna's aperture.

Choosing this type of illumination provides two significant advantages. First, it offers pattern stability in the elevation plane that is necessary for DTV operation. Second, it capitalizes on the feed system of the dipoles, which can be positioned such that the radiator transformers and feedlines do not reside in the high power part of the UHF aperture. This in turn minimizes the effect the VHF antenna has on the radiation patterns of the UHF antenna.

It is now apparent that the antenna system design of the present invention has a number of features and advantages over the prior art, particularly in respect to increased broadband bandwidth capabilities, minimal tower wind loading, no beam sway, and improved antenna output response performance suitable for simultaneous UHF and low- and mid-band VHF broadcasts, etc.

While the invention has been described in terms of various preferred embodiments, those skilled in the art will recognize that the many features and advantages of the invention are apparent from the detailed specification, and that various modifications, substitutions, omissions and changes can be made without departing from the spirit of the present invention.

Accordingly, it is intended that all suitable modifications and equivalents may be resorted to as falling within the scope of the invention.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An antenna for simultaneous UHF and VHF broadcast, said antenna comprising:

a coaxial antenna having an inner conductor and an outer conductor;

a coaxial antenna feed line connected to said coaxial antenna;

a plurality of dipole antennas mounted to the outer conductor of said coaxial antenna; and a dipole antenna feed line for feeding said dipole antennas separate from said coaxial antenna feed line.

2. The antenna of claim 1 wherein said plurality of dipole antennas are equally spaced concentrically around the outer conductor.

3. The antenna of claim 2 wherein said plurality of dipole antennas is three antennas.

4. The antenna of claim 3 wherein said antenna further comprises four additional groups of three dipole antennas arranged concentrically around and mounted to said outer conductor.

5. The antenna of claim 4 wherein said coaxial antenna transmits a UHF signal and said dipole antennas transmit a VHF signal.

6. The antenna of claim 5 wherein said five groups of three dipole antennas are equally spaced axially along said coaxial outer conductor.

7. The antenna of claim 4 wherein said inner conductor comprises a first transmission line inner and a first transmission line outer.

8. The antenna of claim 7 wherein said inner conductor is center fed to reduce phase taper.

9. The antenna of claim 8 wherein said center feed is substantially intermediate a top short and bottom short.

10. An antenna for simultaneous UHF and VHF broadcast, said antenna comprising:

UHF antenna means for transmitting a UHF signal;

UHF antenna feed means for feeding said UHF antenna means;

VHF antenna means having a plurality of VHF antennas mounted to said UHF antenna means for transmitting a VHF signal; and VHF feed means for feeding said VHF antenna means separate from said UHF antenna feed means.

11. The antenna of claim 10 wherein said feed means includes a branch feed means to feed said plurality of VHF antennas to improve vertical pattern stability.

12. The antenna of claim 11 wherein said UHF antenna means includes an inner conductor means for feeding said UHF antenna.

13. The antenna of claim 12 wherein said inner conductor means includes a transmission line inner means and a transmission line outer means for reducing phase taper and beam sway.

14. A method of constructing a UHF and VHF broadcast antenna, comprising the steps of:

forming a coaxial antenna having an inner and outer conductor;

mounting a plurality of dipole antennas to said outer conductor of said coaxial antenna;

connecting a feed line to said plurality of dipole antennas.

15. The method of claim 14 wherein said mounting step includes the step of spacing a group of said plurality of said dipole antennas equidistant concentrically around said outer conductor.

16. The method of claim 15 wherein said mounting step further includes the step of spacing a plurality of groups of said plurality of said dipole antennas equidistant axially along said outer conductor.

17. The method of claim 16 wherein said step of forming a coaxial antenna includes the steps of constructing said inner conductor to have a transmission inner and transmission outer.

18. The method of claim 17 wherein said step of constructing said inner conductor further includes the step of providing a feed point at the approximate center point of between a top short and a bottom short of said coaxial antenna.

19. The method of claim 18 further comprising the step of connecting a feed line to said dipole antennas includes the step of branching said feed line and feeding a first set of said plurality of said dipole antennas off one branch and a second set of said plurality of said dipole antennas off a second branch.

* * * * *